US006129461A

United States Patent [19]

Nakai

[11] Patent Number: 6,129,461

[45] Date of Patent: Oct. 10, 2000

[54] IMAGE RECORDING APPARATUS HAVING ADJUSTMENT STRUCTURE

[75] Inventor: Hiroshi Nakai, Yokohama, Japan

[73] Assignee: Canon Kabushiki Kaisha, Tokyo, Japan

[21] Appl. No.: 09/006,176

[22] Filed: Jan. 13, 1998

[30] Foreign Application Priority Data

Jan. 13, 1997 [JP] Japan ..... 9-004129
Jan. 6, 1998 [JP] Japan ..... 10-001149

[51] Int. Cl.[7] ..... B41J 11/20

[52] U.S. Cl. ..... 400/59; 400/320; 400/355; 400/652

[58] Field of Search ..... 347/8; 400/55, 400/56, 57, 58, 59, 319, 320, 352, 355, 649, 652

[56] References Cited

U.S. PATENT DOCUMENTS 5,000,591 3/1991 Burgess ..... 400/56
5,065,169 11/1991 Vincent et al. ..... 346/140 R
5,087,141 2/1992 Kelly ..... 400/352
5,170,184 12/1992 Hanabusa et al. .

FOREIGN PATENT DOCUMENTS 0 440 464 8/1991 European Pat. Off. .
0 748 697 12/1996 European Pat. Off. .
57-152975 9/1982 Japan .
59-214675 12/1984 Japan .

*Primary Examiner*—John Hilten
*Attorney, Agent, or Firm*—Fitzpatrick, Cella, Harper & Scinto

[57] ABSTRACT

In an image recording apparatus, if a main sheet feed roller is displaced during rotation thereof, a carrier contacted with an outer peripheral surface of the main sheet feed roller via a pressure plate is rotated around a guide shaft upwardly or downwardly. As a result, a position of a nozzle of a recording head held by the carrier is changed. Further, a platen is rotated around support shafts upwardly or downwardly in response to rotation of the carrier around the guide shaft. As a result, a position of a recording surface of the platen is changed. In this way, even if the main sheet feed roller is displaced during rotation thereof, a distance between the nozzle surface of the recording head and a recording medium on the recording surface of the platen is always kept constant.

18 Claims, 17 Drawing Sheets

IMAGE RECORDING APPARATUS HAVING ADJUSTMENT STRUCTURE

BACKGROUND OF THE INVENTION

1. Field of the Invention

The present invention relates to an image recording apparatus such as a printer and the like.

2. Related Background Art

Some image recording apparatuses such as printers have a recording head as a recording means. In such image recording apparatuses, in order to obtain a good recorded image, a distance between a surface of a recording head opposed to a recording medium (for example, a surface in which ink discharge openings are formed in an ink jet recording head) and the recording medium must be kept constant. However, a thickness of the recording medium used in the image recording apparatus varies with kinds of the recording media (normal sheet, thick sheet, envelope and the like). It is desirable that the above-mentioned distance is kept constant even when the thickness of the recording medium is changed.

FIGS. 15 and 16 show a conventional image recording apparatus in which the above-mentioned problem is taken into consideration.

A main sheet feed roller 1 is constituted by a core portion 1*a* and a convey portion 1*b* having an outer peripheral surface of predetermined coefficient of friction, and a shaft portion (not shown) formed integrally with the core portion 1*a* is rotatably supported by left and right inner walls (not shown) of a frame 2. A sub sheet feed roller 3 is rotatably supported by a platen 4 and has an outer peripheral surface of predetermined coefficient of friction.

A pressure plate 22 is pivotally supported by the inner walls (not shown) of the frame 2 and is biased upwardly by a pressure plate spring 23 so that it can be rocked at a predetermined timing. A sheet stack P resting on the pressure plate 22 is urged against the convey portion 1*b* of the main sheet feed roller 1 so that only an uppermost sheet (recording medium) can be supplied.

Spurs 5 each formed from a thin plate having teeth at its outer periphery are supported by a spur holder 6 via an elastic shaft 5*a* formed from an elastic body such as a spring and are urged against the sub sheet feed roller 3 with predetermined pressure by the elastic shaft 5*a* so that the spurs are rotatingly driven by rotation of the sub sheet feed roller 3.

An idle roller 7 is urged against the main sheet feed roller 1 and the sub sheet feed roller 3 substantially along a tangential direction by means of an idle roller spring 8 secured to a predetermined position on the platen 4 so that a rotational force of the main sheet feed roller 1 can be frictionally transmitted to the sub sheet feed roller 3. Auxiliary rollers 26 are driven rollers and are rotatably urged against the convey portion 1*b* by an urging spring 27 disposed along a sheet guide surface 2*e* so that the recording medium P to be conveyed is urged against the convey portion 1*b* to thereby enhance a conveying force of the convey portion 1*b* for the recording medium.

Left and right outer plates (not shown) are provided outside of the frame 2, and a central U-shaped sheet guide surface 2*e* and left and right inner walls (not shown) acting as lateral guides are provided. A guide shaft 10 is supported by the left and right outer plates, and a carrier 12 is slidably mounted on the guide shaft. A recording head 9 is of a so-called disposable type having a recording portion and an ink tank and is detachably mounted on the carrier 12.

The carrier 12 is connected to a timing belt (not shown) wound around and mounted on a motor pulley (not shown) of a carrier motor (not shown) provided near the right outer plate of the frame 2 and a tension pulley (not shown) provided near the left outer plate of the frame 2. As a result, when the carrier motor is driven, a driving force of the carrier motor is transmitted to the carrier 12 through the timing belt to scan the carrier along the guide shaft 10 and an auxiliary guide 11. A slide portion 12*a* of the carrier 12 is contacted with a slide surface 19*a* of a pressure plate 19 so that, when the carrier is scanned, it is reciprocally shifted while sliding on the slide surface.

The pressure plate 19 is formed from a plate-shaped member also acting as a sheet guide and has a base end 19*b* secured to the frame 2 and a tip end for rotatably holding needle rollers 20. The needle rollers 20 are urged against the outer peripheral surface of the main sheet feed roller 1 and are rotatingly driven by the rotation of the main sheet feed roller 1. The pressure plate 19 has flexibility along a direction (longitudinal direction) substantially perpendicular to a sheet conveying direction, and the needle rollers 20 are urged against the convey portion 1*b* at respective positions with predetermined pressure by means of urging springs 21 provided along the longitudinal direction.

The platen 4 is secured to the frame 2 at a predetermined position. The platen 4 is disposed in correspondence to an upper part of the main sheet feed roller 1 and has a recording surface 4*a* opposed to a nozzle surface 9*a* of the recording head 9 and a bearing portion (not shown) for rotatingly supporting the sub sheet feed roller 3.

With the above-mentioned arrangement, while the recording medium P is being conveyed in contact with or in the vicinity of the recording surface 4*a* of the platen 4, an image is recorded on the recording medium by the recording head 9. In this case, when the recording medium P is a relatively thin sheet such as a normal sheet, as shown in FIG. 16, the recording medium P on the recording surface 4*a* is substantially in parallel with the nozzle surface 9*a* so that a distance (Δd-1) therebetween is substantially constant so long as dimensions of constructural elements are correct to thereby achieve the good recording.

However, as shown in FIG. 17, when the recording medium P to be conveyed is a relatively thick recording medium such as a thick sheet or an envelope, the needle rollers 20 are lifted upwardly by a distance corresponding to a thickness of the recording medium and the slide surface 19*a* of the pressure plate 19 is also shifted accordingly. Thus, the carrier 12 slidingly contacted with the slide surface 19*a* is rotated around the guide shaft 10, so that the nozzle surface 9*a* of the recording head 9 mounted on the carrier 12 is retarded from the normal position. As a result, the distance between the nozzle surface 9*a* and the recording medium P becomes (Δd-2).

In this image recording apparatus, the guide shaft 10 around which the carrier 12 is rotated, the slide portion 12*a* and the pressure plate 19 are arranged so that the distances (Δd-1) and (Δd-2) become the same as each other, so that the distance between the nozzle surface 9*a* and the recording medium P is automatically kept constant in accordance with the thickness of the recording medium P.

However, in the above-mentioned conventional image recording apparatus, since the platen 4 is secured to the frame 2 at the predetermined position, if the deflection accuracy of the main sheet feed roller 1 is not correct, the needle rollers 20 contacted with the convey portion 1*b* are shifted in accordance with the deflection of the main sheet feed roller 1. Thus, the pressure plate 19 and the carrier 12 are also shifted, so that the distance between the nozzle surface 9*a* and the recording medium P is changed during the recording operation for the single recording medium P. Thus, a good recorded image cannot be obtained.

That is to say, in the above-mentioned conventional image recording apparatus, the U-shaped convey path is used as the sheet passing passage, and, when the recording medium P is passed through such a U-shaped convey path, by providing the main sheet feed roller having a large diameter and the convey path having gentle and large curvature, even the recording medium having great resiliency can be passed through the convey path without generating any curl. In order to manufacture the main sheet feed roller 1 having the large diameter with light-weight and low cost, generally, the core portion of the roller is molded from resin and a rubber ring having predetermined coefficient of friction is fitted on the core portion.

However, when the resin molded core portion is used, a roller having the same high deflection accuracy as a metallic core portion cannot be obtained, and the deflection of the roller is always generated to thereby vary the distance between the nozzle surface and the recording medium.

SUMMARY OF THE INVENTION

The present invention intends to eliminate the above-mentioned conventional drawbacks, and has an object to provide an image recording apparatus in which, even if a main sheet feed roller (main convey roller) is displaced from a normal position due to deflection, a distance between a surface of a recording head opposed to a recording medium and the recording medium can be kept constant to obtain a good recorded image.

An image recording apparatus according to the present invention comprises a platen having a substantially horizontal recording surface on which a recording medium being conveyed is rested, a recording head disposed above the recording surface of the platen for recording an image on the recording medium, a carrier for holding the recording head and reciprocally shifted in a direction perpendicular to a recording medium conveying direction, and a main convey roller having a large diameter and rotated around a rotation axis and adapted to convey the recording medium onto the recording surface of the platen. The carrier can be rotated around a guide shaft so that a surface (opposed to the recording medium) of the recording head is rotated toward and away from the recording surface of the platen, and a part of the carrier is indirectly contacted with an outer peripheral surface of the main convey roller so that the carrier is rotated around the guide shaft in response to rotational displacement of the main convey roller.

Further, in the present invention, the platen is supported for rotational movement around a support shaft so that, when the platen is rotated around the support shaft, the recording surface is shifted toward and away from the surface (opposed to the recording medium) of the recording head and the platen can be rotated around the support shaft in response to the rotational movement of the carrier around the guide shaft.

DETAILED DESCRIPTION OF THE PREFERRED EMBODIMENTS

The present invention will now be explained in connection with embodiments thereof with reference to the accompanying drawings.

<First Embodiment>

Figure 1:
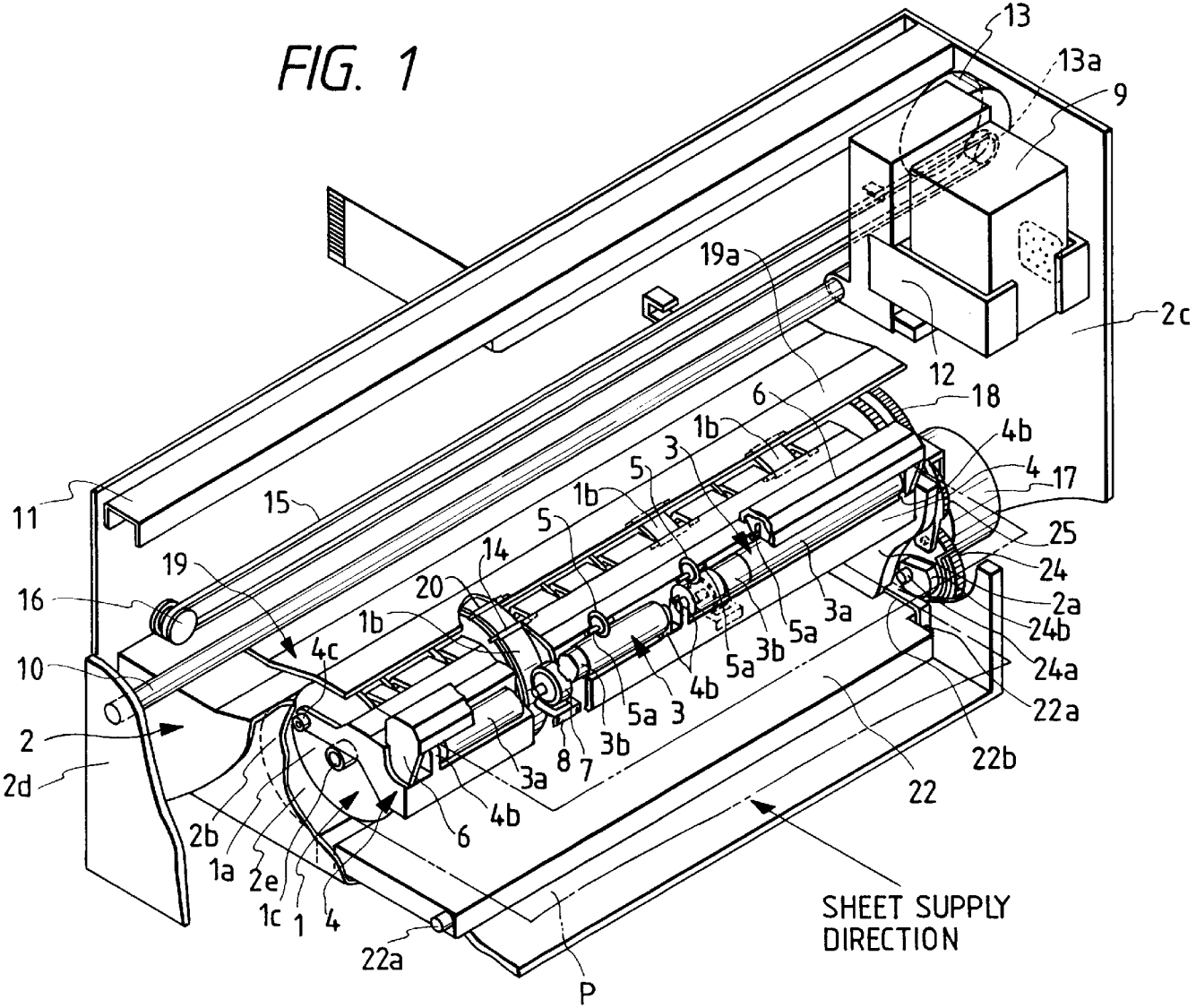
FIG. 1 is a perspective view of an image recording apparatus according to a first embodiment of the present invention.
Figure 2:
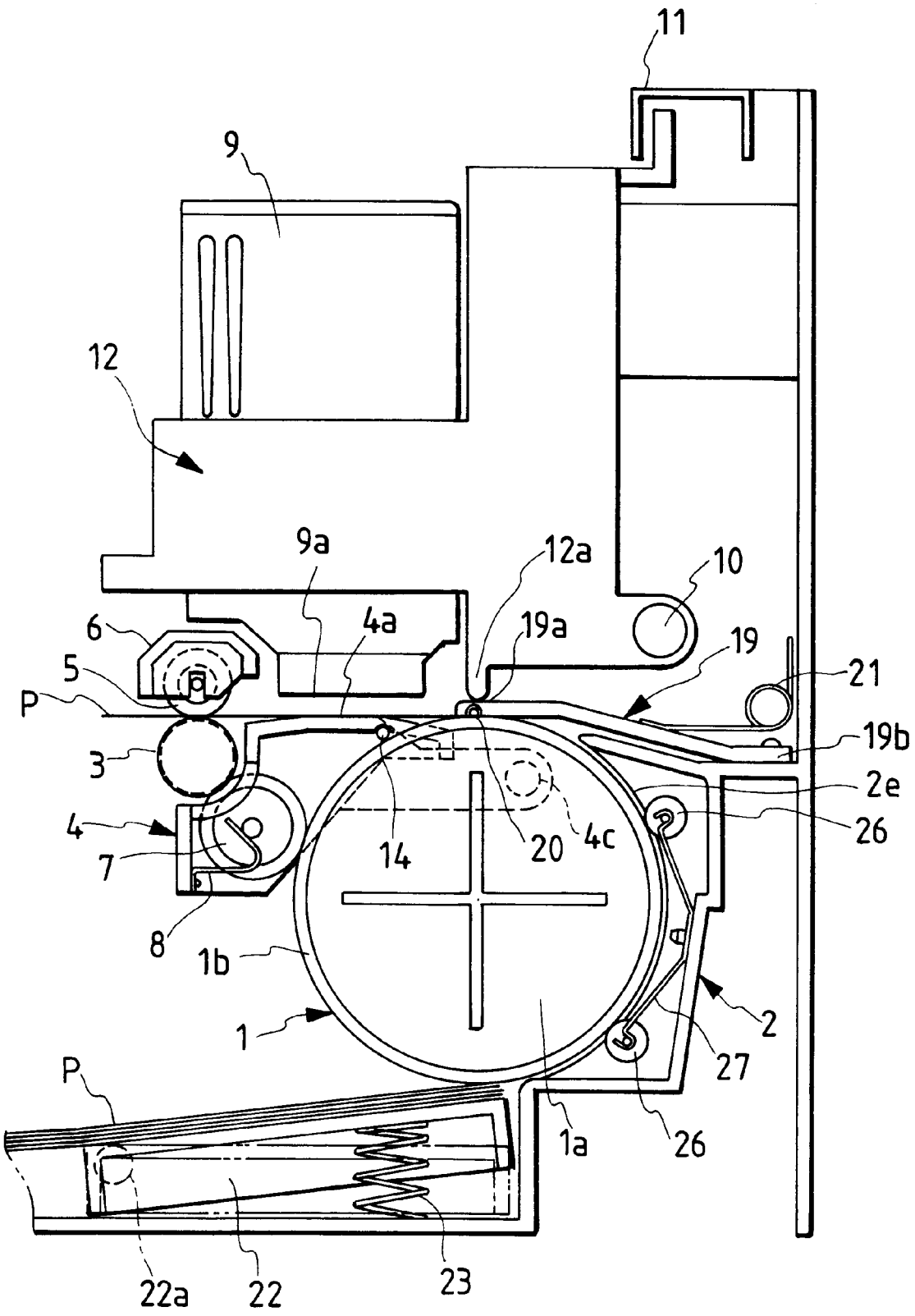
FIG. 2 is a sectional view of the image recording apparatus.

First of all, main constructural elements will be described with reference to FIGS. 1 and 2.

A main sheet feed roller 1 as a rotary member is constituted by a cylindrical core portion 1*a* molded from resin and a convey portion 1*b* having an outer peripheral surface of predetermined coefficient of friction. A shaft portion 1*c* formed integrally with the core portion 1*a* is rotatably supported by left and right inner walls 2*a*, 2*b* of a frame 2.

A sub sheet feed roller 3 is rotatably supported by a platen 4 as a guide member and has an outer peripheral surface of predetermined coefficient of friction. As shown in FIG. 1, the sub sheet feed roller 3 comprises a large diameter sheet feed portion 3*a,* and a drive transmitting portion 3*b* having a diameter slightly smaller than the diameter of the sheet feed portion 3*a* (by about 1 to 6%).

Spurs 5 each formed from a thin plate having teeth at its outer periphery are supported by a spur holder 6 via an elastic shaft 5*a* (FIG. 1) formed from an elastic body such as a spring and are urged against the sub sheet feed roller 3 with predetermined pressure by the elastic shaft 5*a* so that the spurs are rotatingly driven by rotation of the sub sheet feed roller 3. An idle roller 7 is urged against the main sheet feed roller 1 and the drive transmitting portion 3*b* of the sub sheet feed roller 3 substantially along a tangential direction by means of an idle roller spring 8 secured to a predetermined position on the platen 4 so that a rotational force of the main sheet feed roller 1 can be frictionally transmitted to the sub sheet feed roller 3.

The frame 2 is provided with a right outer plate 2*c* and a left outer plate 2*d,* and a central U-shaped sheet guide surface 2*e* and left and right inner walls 2*b,* 2*a* acting as lateral guides are provided. A guide shaft 10 for guiding a carrier 12 is supported by the left and right outer plates 2*d,* 2*c* of the frame 2. The carrier 12 is slidably mounted on the guide shaft 10. An auxiliary guide 11 for guiding the carrier 12 is supported by the left and right outer plates 2*d,* 2*c* of the frame 2.

A recording head (recording means) 9 is of the type having a recording portion and an ink tank and is detachably mounted on the carrier 12.

A carrier motor 13 is provided near the right outer plate 2*c* of the frame 2. A motor pulley 13*a* is secured to a shaft of the carrier motor 13. A timing belt 15 is wound around and mounted on the motor pulley 13*a* and a tension pulley 16 provided near the left outer plate 2*d* of the frame 2, and a portion of the timing belt is connected to a lower portion of the carrier 12.

With this arrangement, when the carrier motor 13 is driven, a driving force of the carrier motor is transmitted to the carrier 12 through the timing belt 15 to scan the carrier 12 along the guide shaft 10 and the auxiliary guide 11.

A slide portion 12*a* of the carrier 12 is contacted with a slide surface 19*a* of a pressure plate 19 so that, when the carrier is scanned, it is reciprocally shifted while sliding on the slide surface 19*a*. The pressure plate 19 is formed from a plate-shaped member acting as a sheet guide and has a base end 19*b* secured to the frame 2 and a tip end for rotatably holding needle rollers (first followers) 20. The needle rollers 20 are urged against the outer peripheral surface of the convey portion 1*b* of the main sheet feed roller 1 and are rotatingly driven by the rotation of the main sheet feed roller 1.

The pressure plate 19 has flexibility along a direction (longitudinal direction) perpendicular to a sheet conveying direction, and the needle rollers 20 are urged against the convey portion 1*b* at respective positions with predetermined pressure by means of urging springs 21 (FIG. 2) provided along the longitudinal direction.

A convey motor 17 is provided on a stay (not shown) near the right inner wall 2*a* of the frame 2. A pinion (not shown) is secured to a shaft of the convey motor 17 and a roller gear 18 attached to one end of the shaft 1*c* of the main sheet feed roller 1 is meshed with the pinion. Accordingly, when the convey motor 17 is driven, a driving force of the convey motor is transmitted to the shaft 1*c* through the pinion and the roller gear 18 to rotate the main sheet feed roller 1, idle roller 7 and sub sheet feed roller 3, so that the spurs 5 urged against the sub sheet feed roller 3 are rotatingly driven to thereby convey a recording medium.

Auxiliary rollers 26 are driven rollers and are rotatably urged against the convey portion 1*b* by an urging spring 27 disposed along the sheet guide surface 2*e* so that the recording medium P to be conveyed is urged against the convey portion 1*b* to thereby enhance a conveying force of the convey portion 1*b* for the recording medium.

A pressure plate 22 is pivotally supported by the inner walls 2*a,* 2*b* of the frame 2 via a shaft portion 22*a* and is biased upwardly by a pressure plate spring 23 so that a sheet stack P rested on the pressure plate 22 is urged against the convey portion 1*b* of the main sheet feed roller 1 to supply only an uppermost sheet (recording medium).

Regarding the pressure plate 22, in a normal condition, a cam abutment portion 22*b* of the pressure plate 22 is biased downwardly by a cam portion 24*b* of a pressure plate gear 24 rotatably supported by a shaft portion 24*a* disposed near the right inner wall 2*a* of the frame 2, so that the sheet stack P is spaced apart from the convey portion 1*b* of the main sheet feed roller 1. When a print command is emitted from a host computer, the carrier 12 is shifted to a predetermined position to lower an intermediate gear 25, so that the intermediate gear 25 is engaged by the roller gear 18 and the pressure plate gear 24.

Thereafter, when the convey motor 17 is driven to rotate the main sheet feed roller 1 and the pressure plate gear 24, the pressure plate 22 is inclined downwardly along the profile of the cam portion 24*b* by means of the pressure plate spring 23. When the sheet stack P is contacted with the convey portion 1*b* of the main sheet feed roller 1, only the uppermost recording medium is supplied by the friction force of the convey portion 1*b*.

When the pressure plate gear 24 is further rotated, the cam abutment portion 22*b* is lowered along the profile of the cam portion 24*b,* so that the sheet stack is separated from the convey portion 1*b* and the pressure plate 22 is returned to its original condition. When the carrier 12 is retarded from a position where the intermediate gear 25 is lowered, the intermediate gear 25 is disengaged from the pressure plate gear 24 by a biasing means (not shown) to thereby finish the rotation of the pressure plate gear 24. The convey motor 17 is further driven to rotate the main sheet feed roller 1, and, a tip end of the recording medium P reaches a predetermined position, the sheet supplying operation is finished.

The platen 4 is disposed in correspondence to an upper part of the main sheet feed roller 1 and has a recording surface 4*a* opposed to a nozzle surface 9*a* of the recording head 9 and a bearing portion 4*b* (FIG. 1) for rotatingly supporting the sub sheet feed roller 3. The platen 4 is provided at its both ends with rotary shafts 4*c* by which the platen is rotatably supported by the inner walls 2*a,* 2*b* of the frame 2.

A rock roller (second follower) 14 is rotatably supported by the platen 4 so that the rock roller is rotatingly driven by the rotation of the main sheet feed roller 1 while urging against the convey portion 1*b* of the main sheet feed roller 1. The rock roller 14 is urged against the outer peripheral surface of the convey portion 1*b* in the vicinity of the needle rollers 20.

Figure 3:
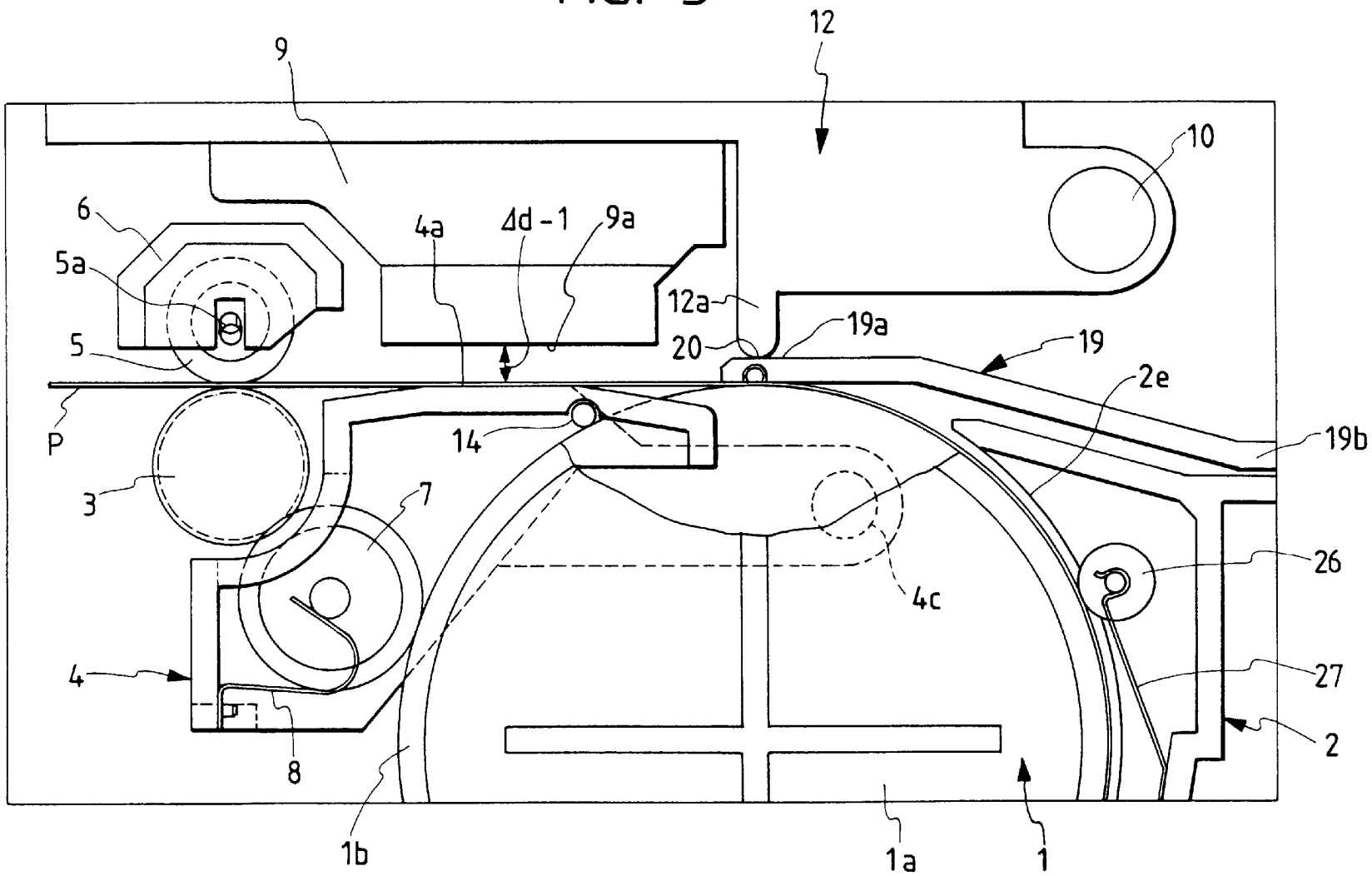
FIG. 3 is a sectional view of a main part of the apparatus, showing a recording surface and a nozzle surface in a normal condition.

With the above-mentioned arrangement, as shown in FIG. 3, the recording medium P on the recording surface 4*a* is substantially in parallel with the nozzle surface 9*a* so that a distance (Δd-1) therebetween is substantially constant so long as dimensions of constructural elements are correct to thereby achieve a good recording.

Figure 4:
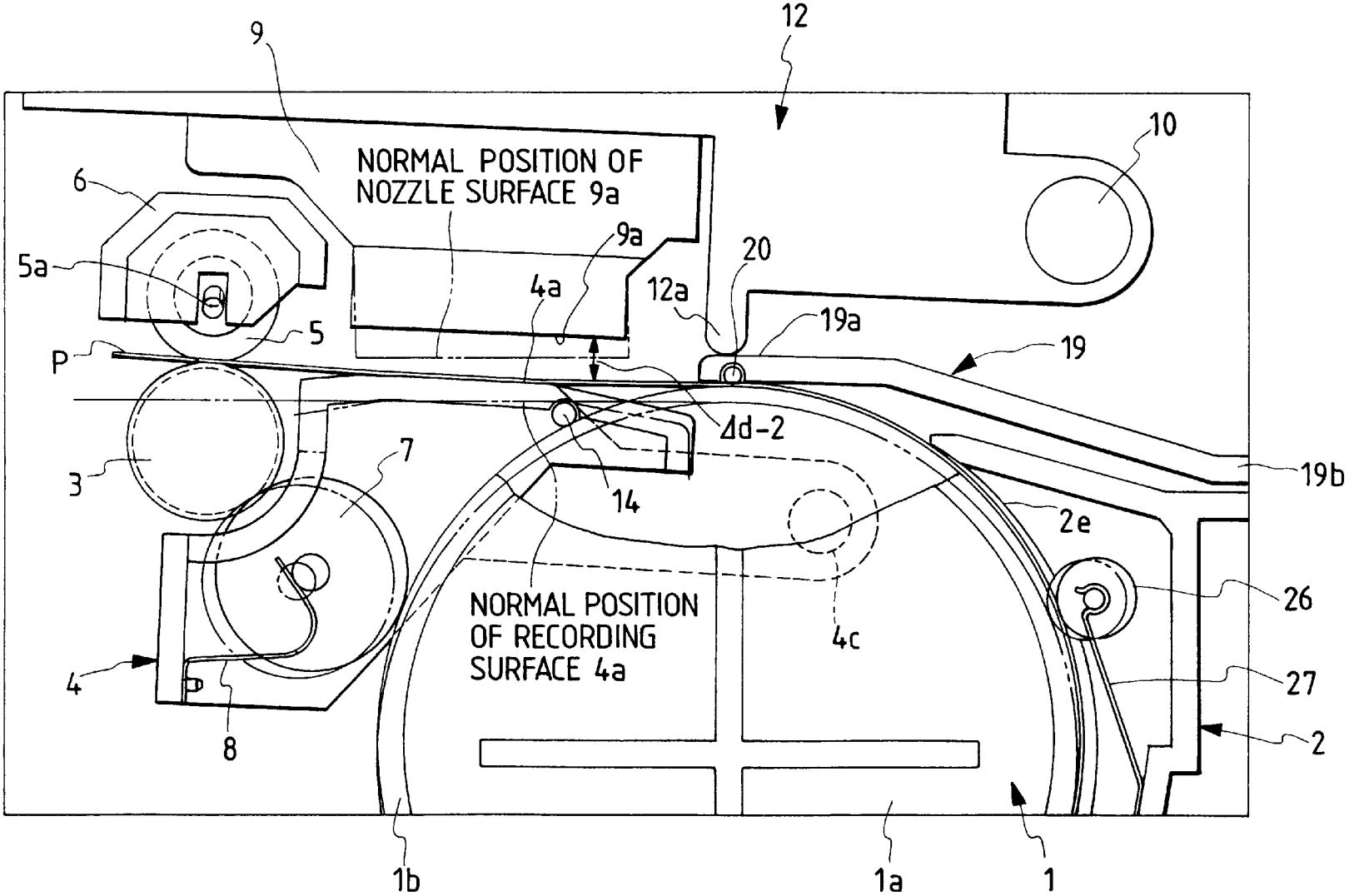
FIG. 4 is a sectional view of a main part of the apparatus, showing a recording surface and a nozzle surface in a case where a convey portion of a main sheet feed roller is displaced from the normal position.

If the outer peripheral surface of the convey portion 1*b* of the main sheet feed roller 1 is changed from a normal position shown by the two-dot and chain line due to deflection, as shown in FIG. 4, the needle rollers 20 urged against the outer peripheral surface of the convey portion 1*b* are shifted accordingly. As a result, the pressure plate 19 and the slide surface 19*a* are also shifted, and the carrier 12 sliding on the slide surface is rotated around the guide shaft 10, and, thus, the nozzle surface 9*a* of the recording head 9 is ultimately shifted from the normal position shown by the two-dot and chain line. That is to say, the pressure plate 19 and the carrier 12 constitute a connection means for connecting the needle rollers 20 to the recording head so that the recording head 9 is displaced in response to the displacement of the needle rollers 20.

However, in the illustrated embodiment, since the rock roller 14 is urged against the outer peripheral surface of the convey portion 1*b* of the main sheet feed roller 1 in the vicinity of the needle rollers 20, the platen 4 is rotated around the rotary shafts 4*c*, so that the recording surface 4*a* is shifted from the normal position shown by the two-dot and chain line. That is to say, the rock roller 14 is connected to the platen so that the recording surface (guide surface) 4*a* of the platen 4 is displaced in response to the displacement of the rock roller 14.

A shift amount of the nozzle surface 9*a* in this case is determined by a relation between a position of the guide shaft 10 around which the carrier 12 is rotated, positions of the slide portion 12*a* and the slide surface 19*a* and a position of the nozzle surface 9*a*.

Similarly, a shift amount of the recording surface 4*a* is determined by a relation between positions of the rotary shafts 4*c* of the platen 4, a position of the rock roller 14 and a position of the recording surface 4*a*. Accordingly, by selecting the positional relations so that the shift amount of the nozzle surface 9*a* becomes substantially the same as the shift amount of the recording surface 4*a*, the nozzle surface 9*a* can always be kept substantially in parallel with the recording medium P on the recording surface 4*a*, and a distance (Δd-1) in the normal condition and a distance (Δd-2) in the displaced condition between the nozzle surface 9*a* and the recording medium P are not influenced by the deflection of the main sheet feed roller 1, so that a good recorded image can always be obtained.

<Second Embodiment>

Figure 5:
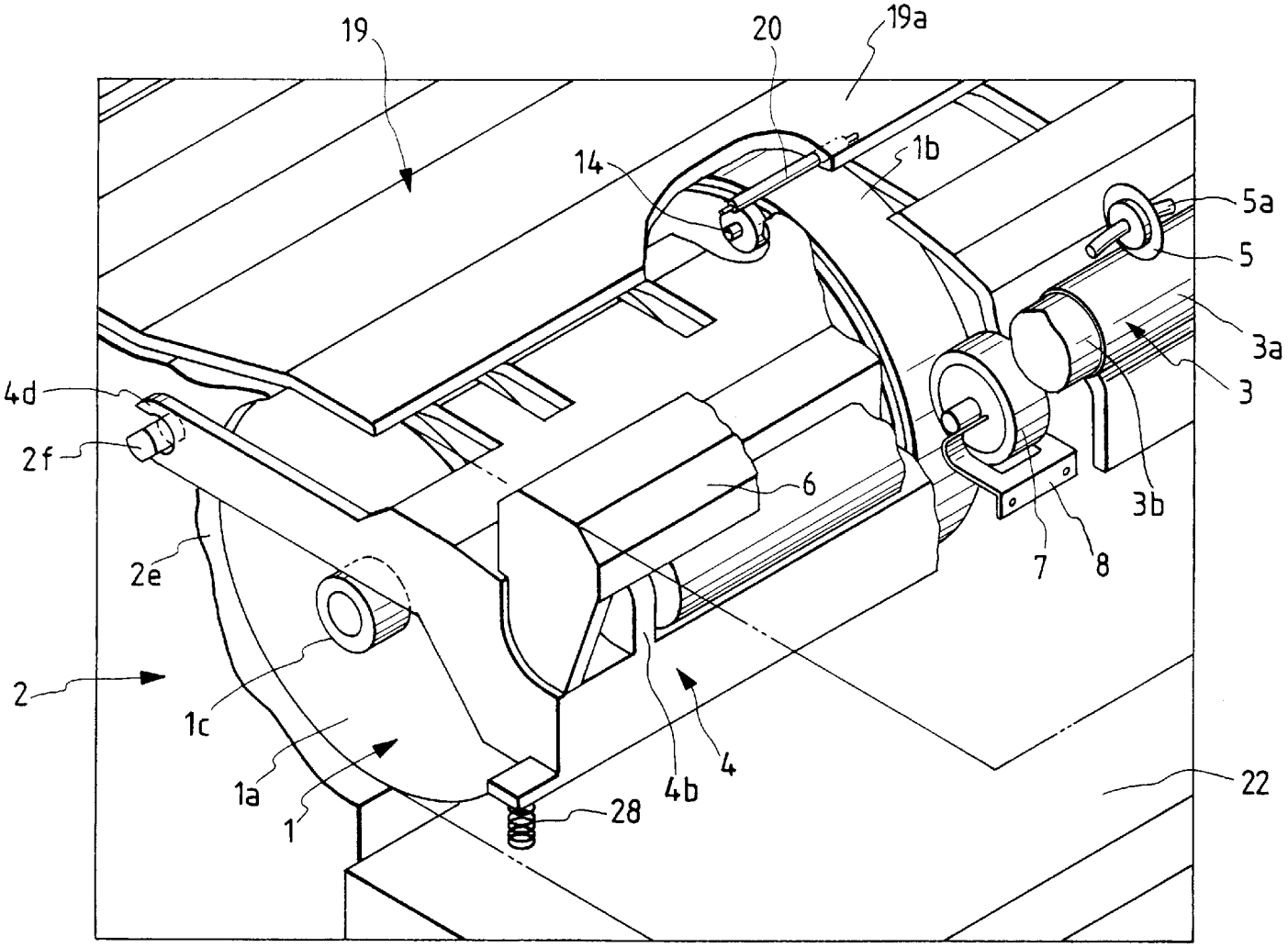
FIG. 5 is a perspective view of a main part of an image recording apparatus according to a second embodiment of the present invention.
Figure 6:
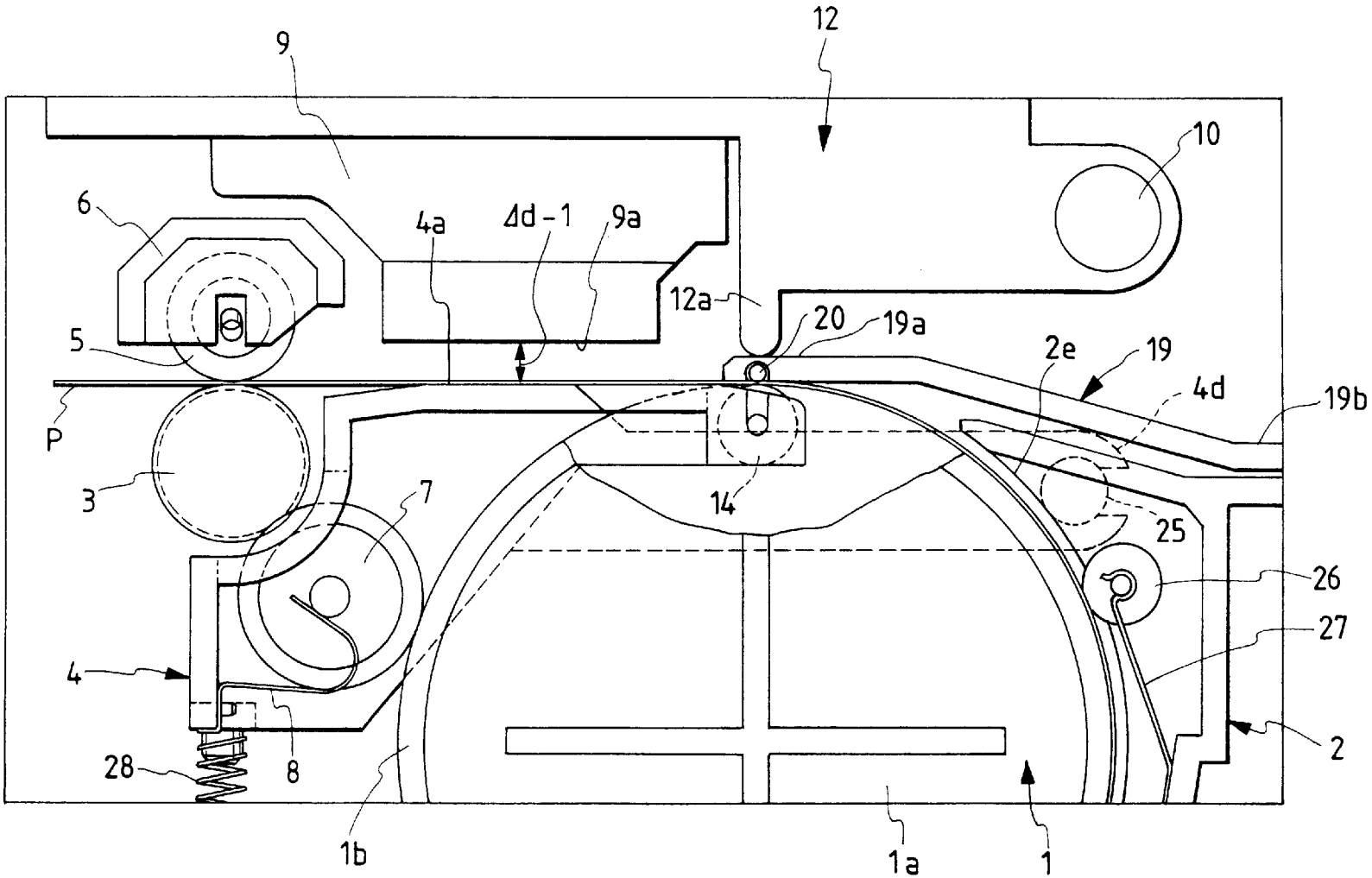
FIG. 6 is a sectional view of a main part of the apparatus, showing a recording surface and a nozzle surface in a normal condition.
Figure 7:
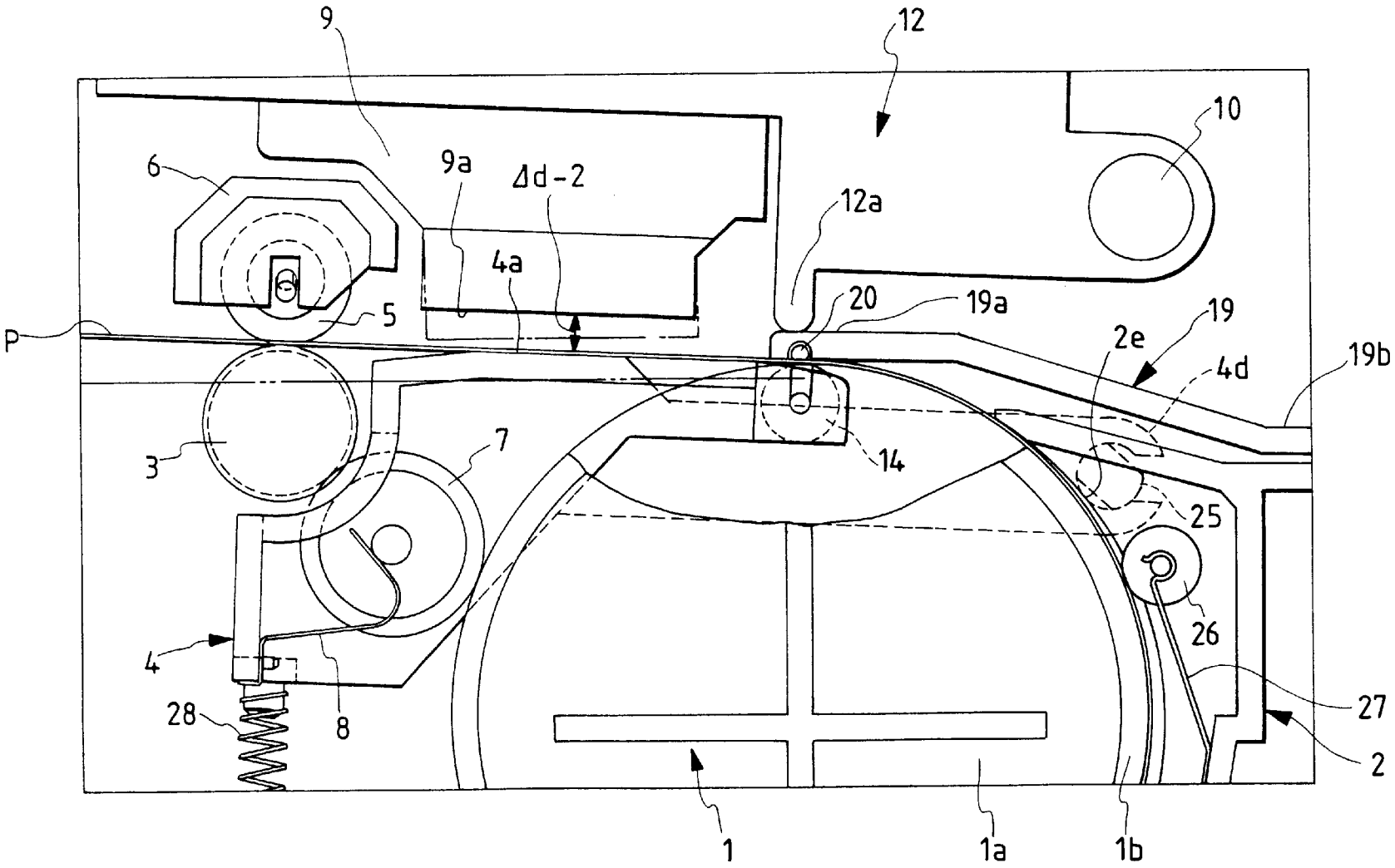
FIG. 7 is a sectional view of a main part of the apparatus, showing a recording surface and a nozzle surface in a case where a convey portion of a main sheet feed roller is displaced from the normal position.
Figure 8:
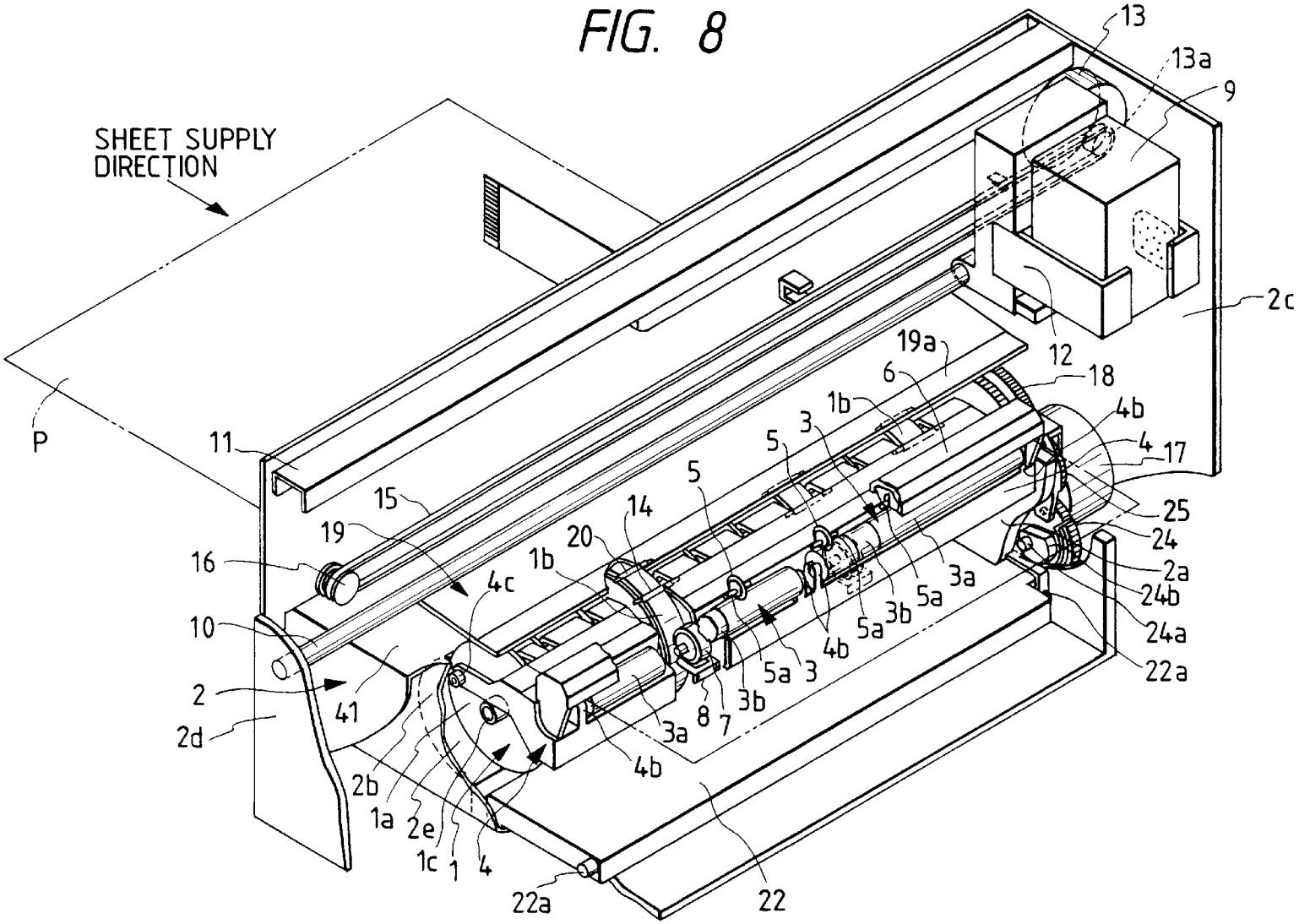
FIG. 8 is a perspective view of an image recording apparatus according to a third embodiment of the present invention.

An image recording apparatus according to a second embodiment of the present invention is shown in FIGS. 5 to 7. Since the fundamental construction of this image recording apparatus is substantially the same as that of the first embodiment, explanation of the same constructural elements will be omitted.

Differences between the second embodiment and the first embodiment are that, instead of urging the rock roller 14 against the convey portion 1*b* of the main sheet feed roller 1, the rock roller is urged against the needle rollers 20 rotatably supported by the pressure plate 19 and that there is provided a platen spring 28 for biasing the platen 4 upwardly to upwardly urge the rock roller 14 against the needle rollers 20.

By urging the rock roller 14 against the needle rollers 20, the movement of the platen 4 follows the movement of the needle rollers 20, so that the errors in the distances (Δd-1), (Δd-2) between the nozzle surface 9*a* of the recording head 9 and the recording medium P on the recording surface 4*a* of the platen 4 can be made further smaller.

In the illustrated embodiment, the platen spring 28 is disposed between the platen 4 and a receiving portion (not shown) of the frame 2 so that the rock roller 14 is urged against the needle rollers 20 with pressure which does not interfere with the urging forces of the needle rollers 20 urged against the convey portion 1*b* of the main sheet feed roller 1 with predetermined pressure.

Shaft portions 2*f* provided near the left and right inner walls 2*b*, 2*a* of the frame 2 rotatably support bearing portions 4*d* of the platen 4. Alternatively, as in the first embodiment, the platen may be supported by the frame via the rotary shaft 4*c*.

In this specification, while an example in which the position of the convey roller 1*b* of the main sheet feed roller 1 is changed upwardly was explained, if the position of the convey roller 1*b* of the main sheet feed roller 1 is changed downwardly, since the nozzle surface 9*a* of the recording head 9 and the recording surface 4*a* of the platen 4 are shifted downwardly, the distance relation and the parallel relation can be maintained.

Further, while an example in which the driven rollers (needle rollers 20) are urged against the convey portion 1*b* of the main sheet feed roller 1 was explained, when the driven rollers have low coefficient of friction, the driven rollers may not be rotated. Further, when the pressure plate 19 is made of material having low coefficient of friction, the pressure plate may be directly urged against the convey portion 1*b*. This is also true regarding the rock roller 14 of the platen 4.

As mentioned above, in the image recording apparatus according to the present invention, when the carrier holding the recording head is rotated around the guide shaft, even if the main sheet feed roller is displaced during the rotation thereof, the distance between the surface (opposed to the recording medium) of the recording head and the recording surface on the recording surface of the platen is always kept constant. This is because the platen is also rotated around the support shaft, thus obtaining the good recorded image. Particularly when the platen is rotated directly in response to the rotational movement of the carrier, the accuracy of the distance is high.

<Third Embodiment>

FIGS. 8 to 11 show a third embodiment of the present invention. In the third embodiment, the same elements as those in the first embodiment are designated by the same reference numerals and explanation thereof will be omitted. Unlike to the first embodiment, in the third embodiment, manual insertion sheet supply can be permitted.

Figure 9:
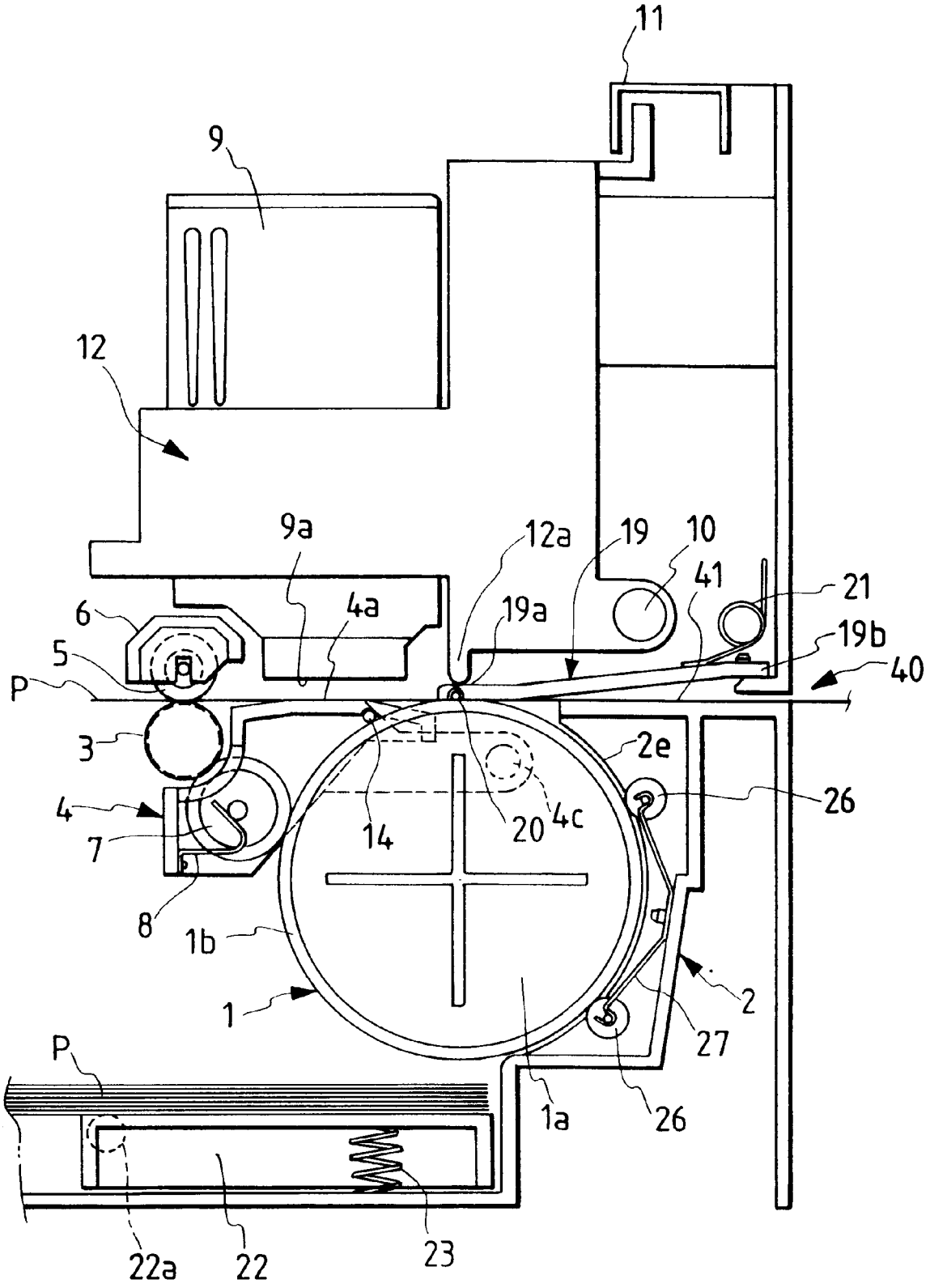
FIG. 9 is a sectional view of the image recording apparatus.

That is to say, as shown in FIG. 9, the frame 2 is provided with a manual insertion opening 40 and a manual insertion guide 41. When the manual insertion sheet supply is effected, a recording medium P is inserted into the image recording apparatus through the manual insertion opening 40 until a tip end of the recording medium abuts against a nip formed between the main sheet feed roller 1 and the needle rollers 20. At this point, the recording medium is detected by a manual insertion sensor (not shown), and, after a predetermined time period is elapsed, the main sheet feed roller 1 is rotated in an anti-clockwise direction (FIG. 9) by a control means.

The control means causes the main sheet feed roller 1 to convey the recording medium P to a predetermined record start position, the recording having a predetermined recording width and a predetermined length in the convey direction is effected by the recording head 9 while shifting the carrier 12 in a width-wise direction of the recording medium. By repeating the recording having the predetermined recording width and the conveyance of the recording medium corresponding to the recording width alternately, the image is recorded on the recording medium.

Figure 10:
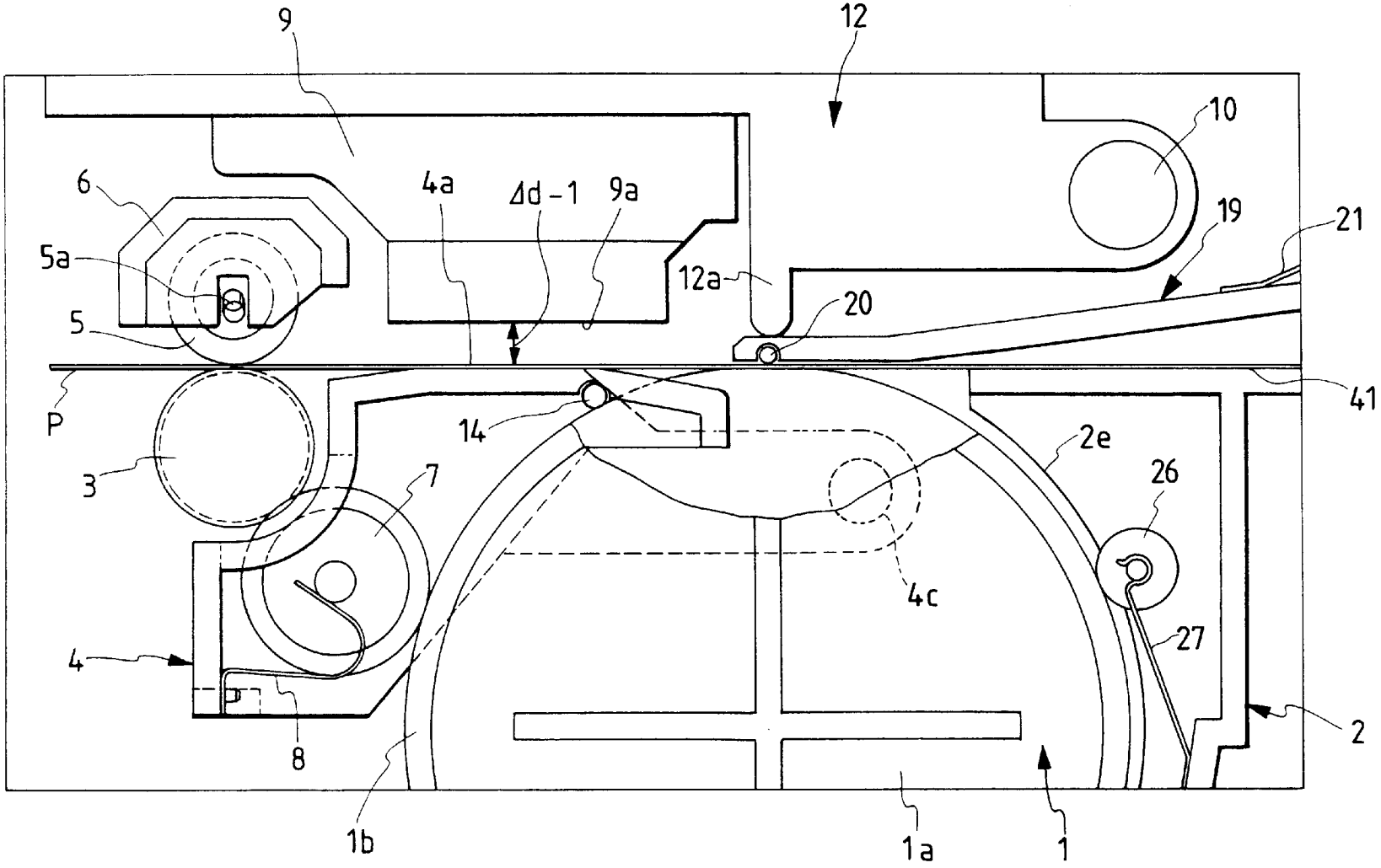
FIG. 10 is a sectional view of a main part of the apparatus, showing a recording surface and a nozzle surface in a normal condition.

So long as dimensions of the constructural elements are correct, as shown in FIG. 10, the recording medium P on the recording surface 4*a* is substantially in parallel with the nozzle surface 9*a* so that a distance (Δd-1) therebetween is substantially constant to thereby achieve a good recording.

Figure 11:
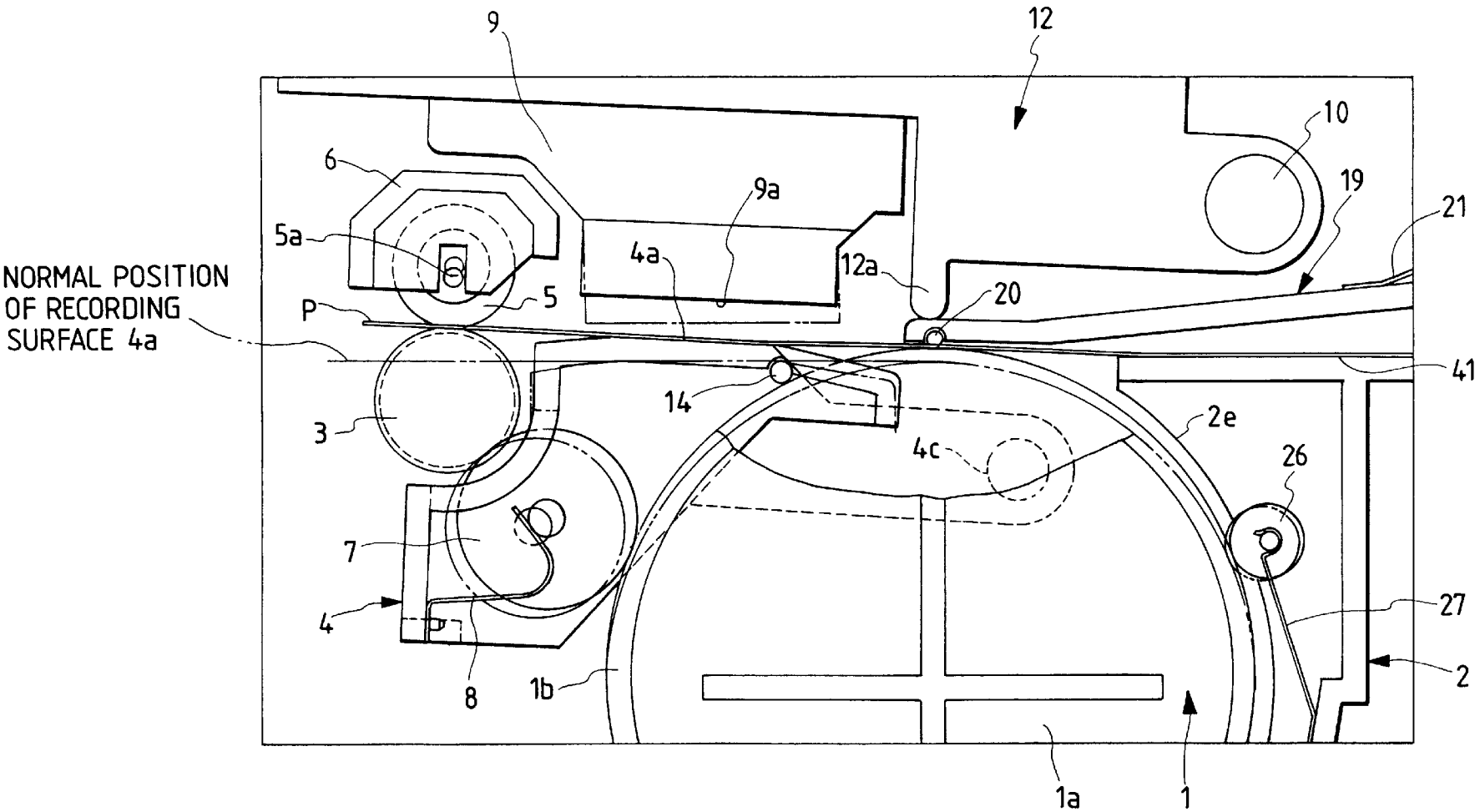
FIG. 11 is a sectional view of a main part of the apparatus, showing a recording surface and a nozzle surface in a case where a convey portion of a main sheet feed roller is displaced from the normal position.

During the rotation of the convey roller (main sheet feed roller) 1, even if the portion of the outer peripheral surface of the convey roller 1 contacted with the needle rollers 20 is vibrated in the up-and-down direction due to the deflection or eccentricity to change the position of the nozzle surface 9*a,* similar to the first embodiment, the distance between the nozzle surface 9*a* and the recording surface 4*a* is kept substantially constant, since the position of the recording surface 4*a* is similarly changed accordingly. That is to say, as shown in FIG. 11, if the outer peripheral surface of the convey portion 1*b* of the main sheet feed roller 1 is displaced from the normal position shown by the two-dot and chain line due to the deflection, the needle rollers 20 urged against the outer peripheral surface of the convey portion 1*b* of the main sheet feed roller 1 are shifted accordingly. As a result, the pressure plate 19 and the slide surface 19*a* are also shifted, and the carrier 12 sliding on the slide surface is rotated around the guide shaft 10, and, thus, the nozzle surface 9*a* of the recording head 9 is ultimately shifted from the normal position shown by the two-dot and chain line.

Further, since the rock roller 14 is urged against the outer peripheral surface of the convey portion 1*b* of the main sheet feed roller 1 in the vicinity of the needle rollers 20, the platen 4 is rotated around the rotary shafts 4*c,* so that the recording surface 4*a* is shifted from the normal position shown by the two-dot and chain line. As is in the first embodiment, by appropriately selecting the positional relation between the guide shaft 10, slide portion 12*a,* needle rollers 20, nozzle surface 9*a,* rotary shafts 4*c* and recording surface 4*a,* the distance between the nozzle surface 9*a* and the recording surface 4*a* can always be kept substantially constant.

<Fourth Embodiment>

Figure 12:
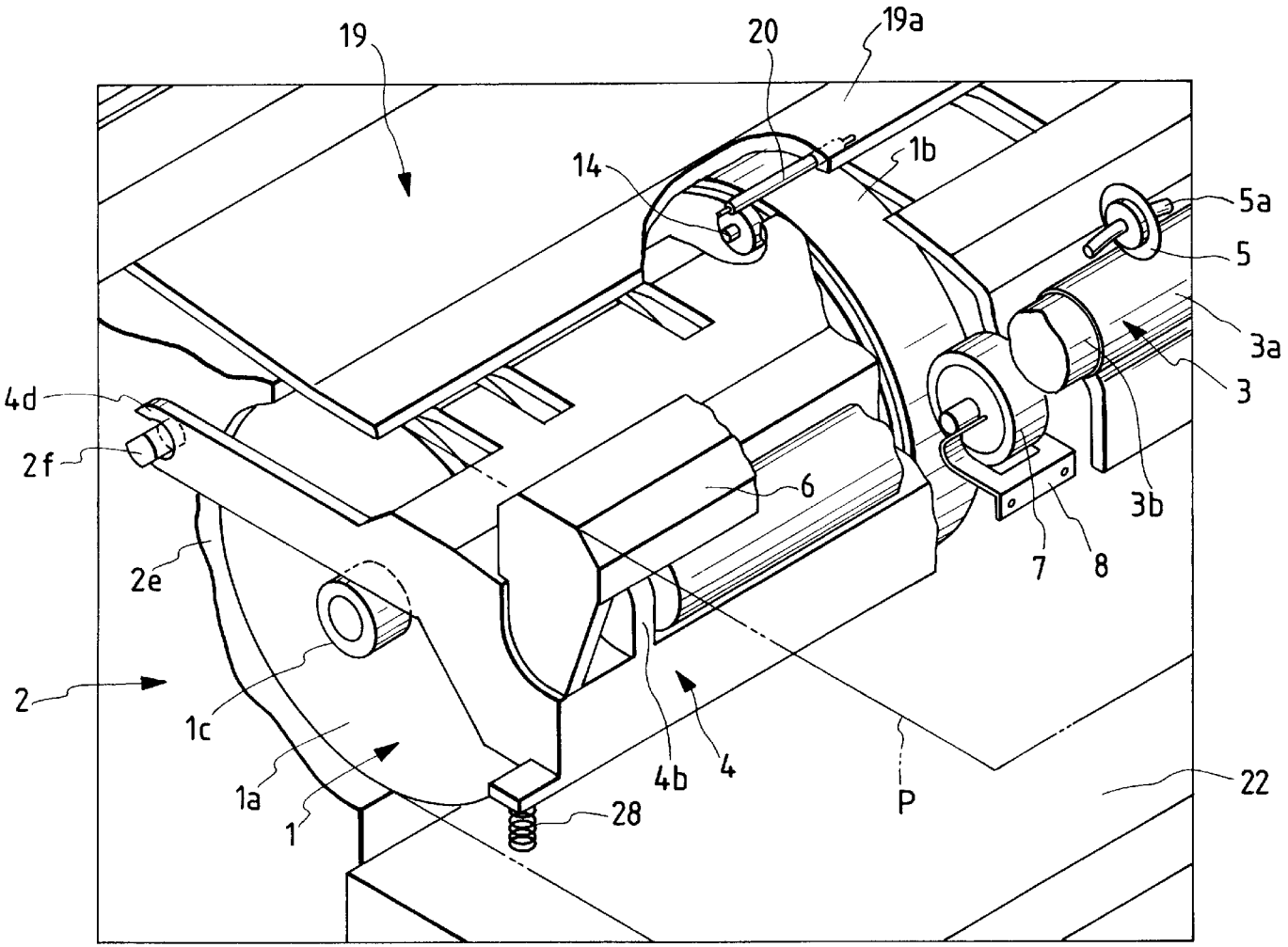
FIG. 12 is a perspective view of a main part of an image recording apparatus according to a fourth embodiment of the present invention.
Figure 13:
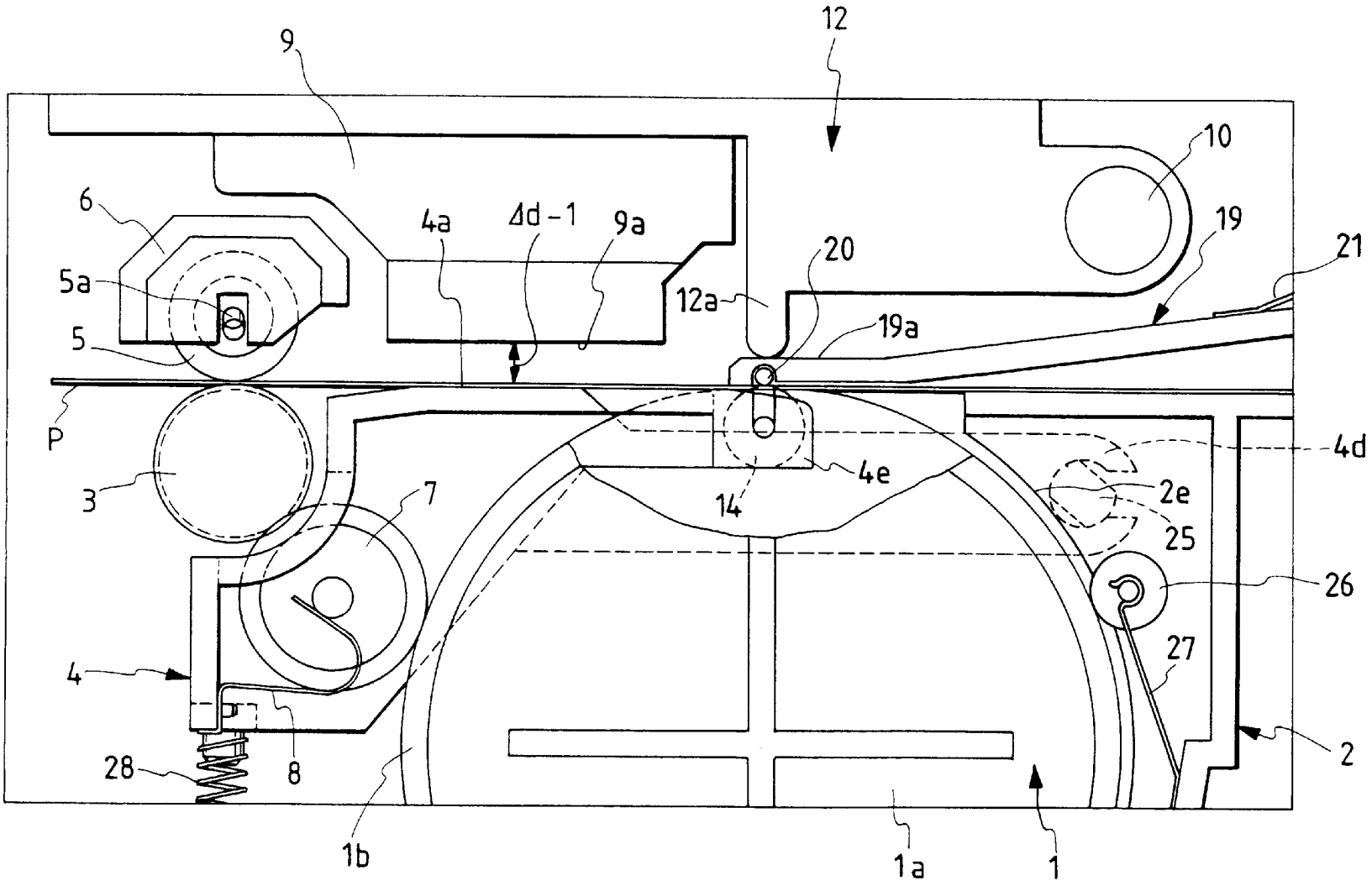
FIG. 13 is a sectional view of a main part of the apparatus, showing a recording surface and a nozzle surface in a normal condition.
Figure 14:
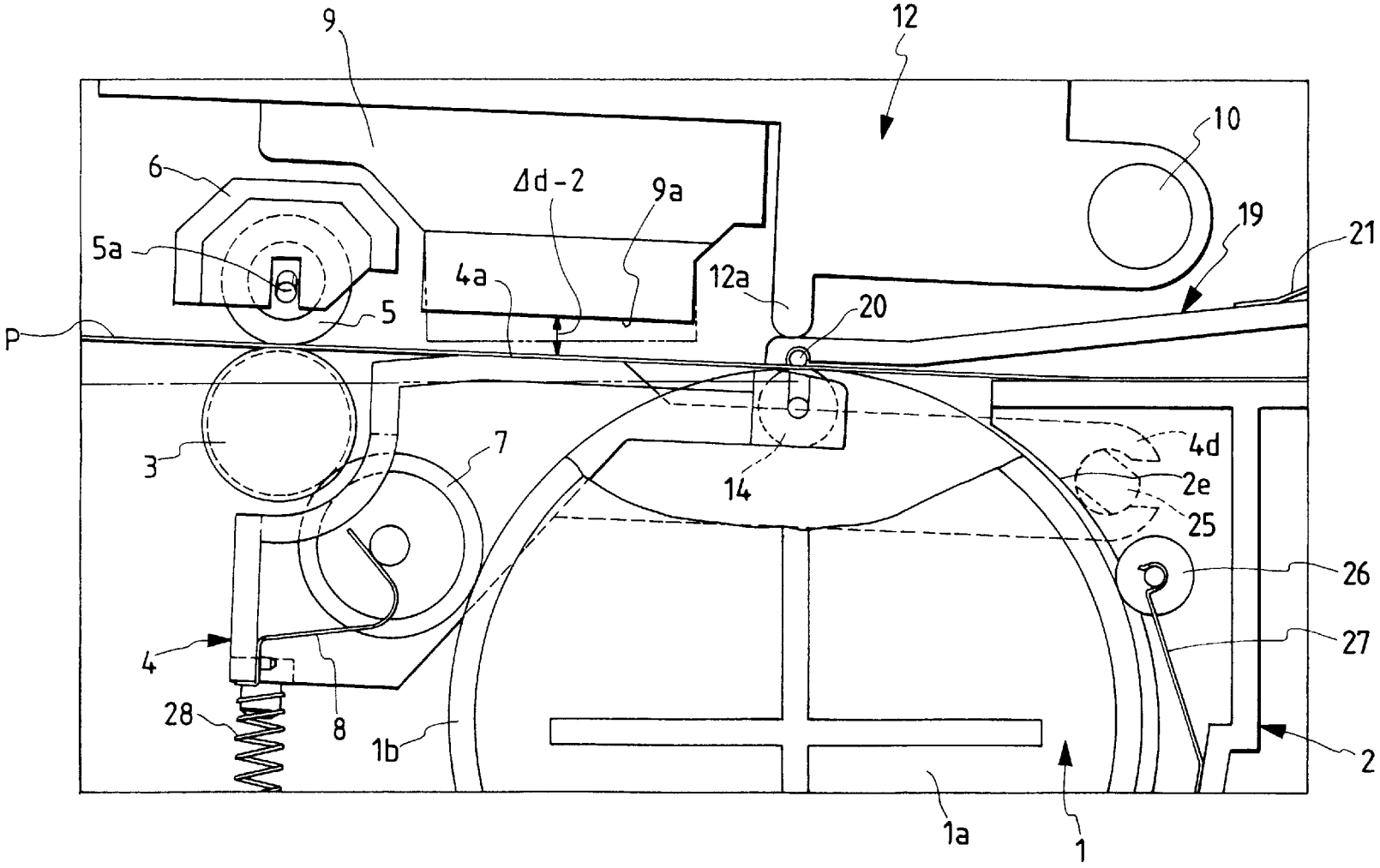
FIG. 14 is a sectional view of a main part of the apparatus, showing a recording surface and a nozzle surface in a case where a convey portion of a main sheet feed roller is displaced from the normal position.
Figure 15:
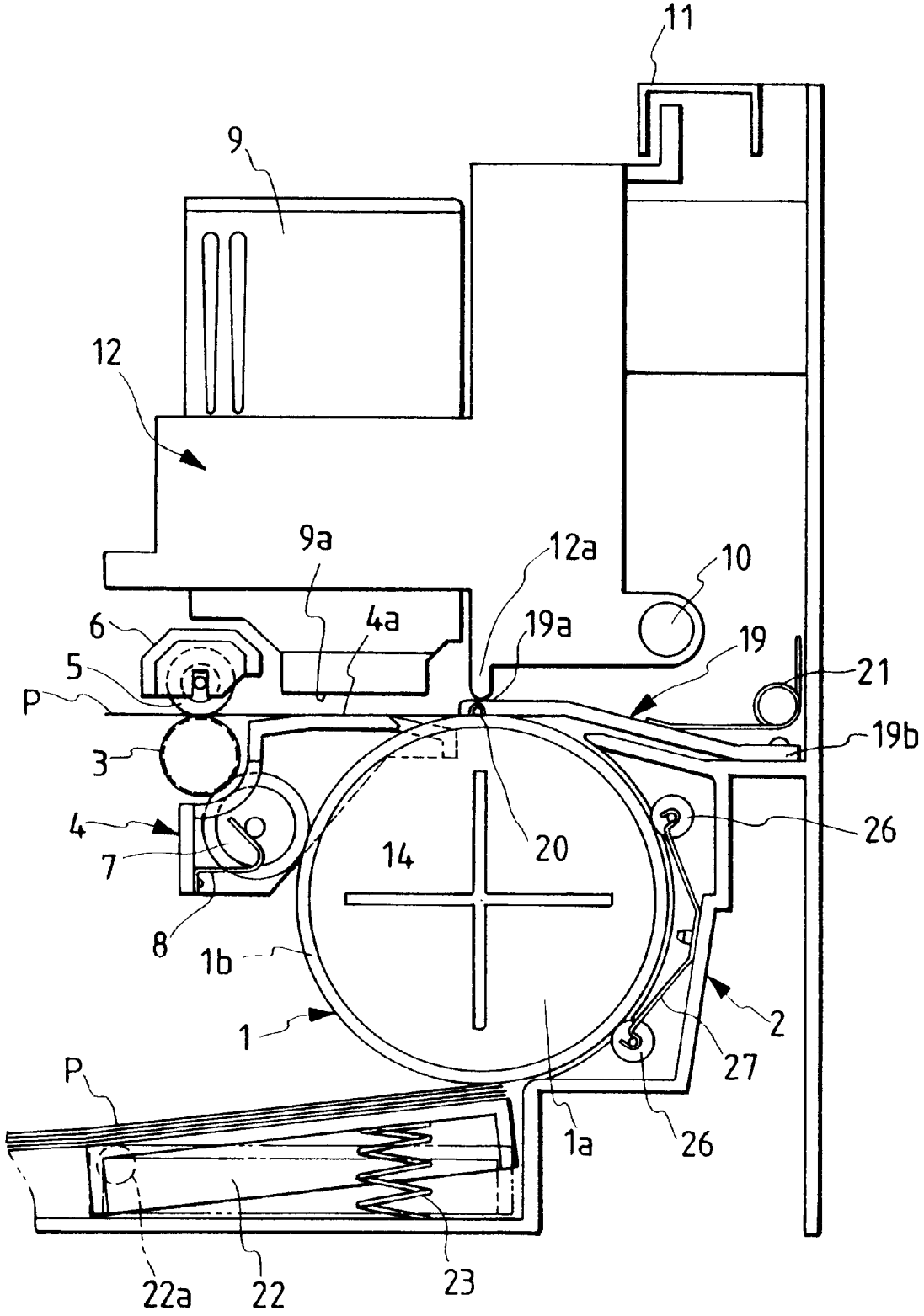
FIG. 15 is a sectional view of a conventional image recording apparatus.
Figure 16:
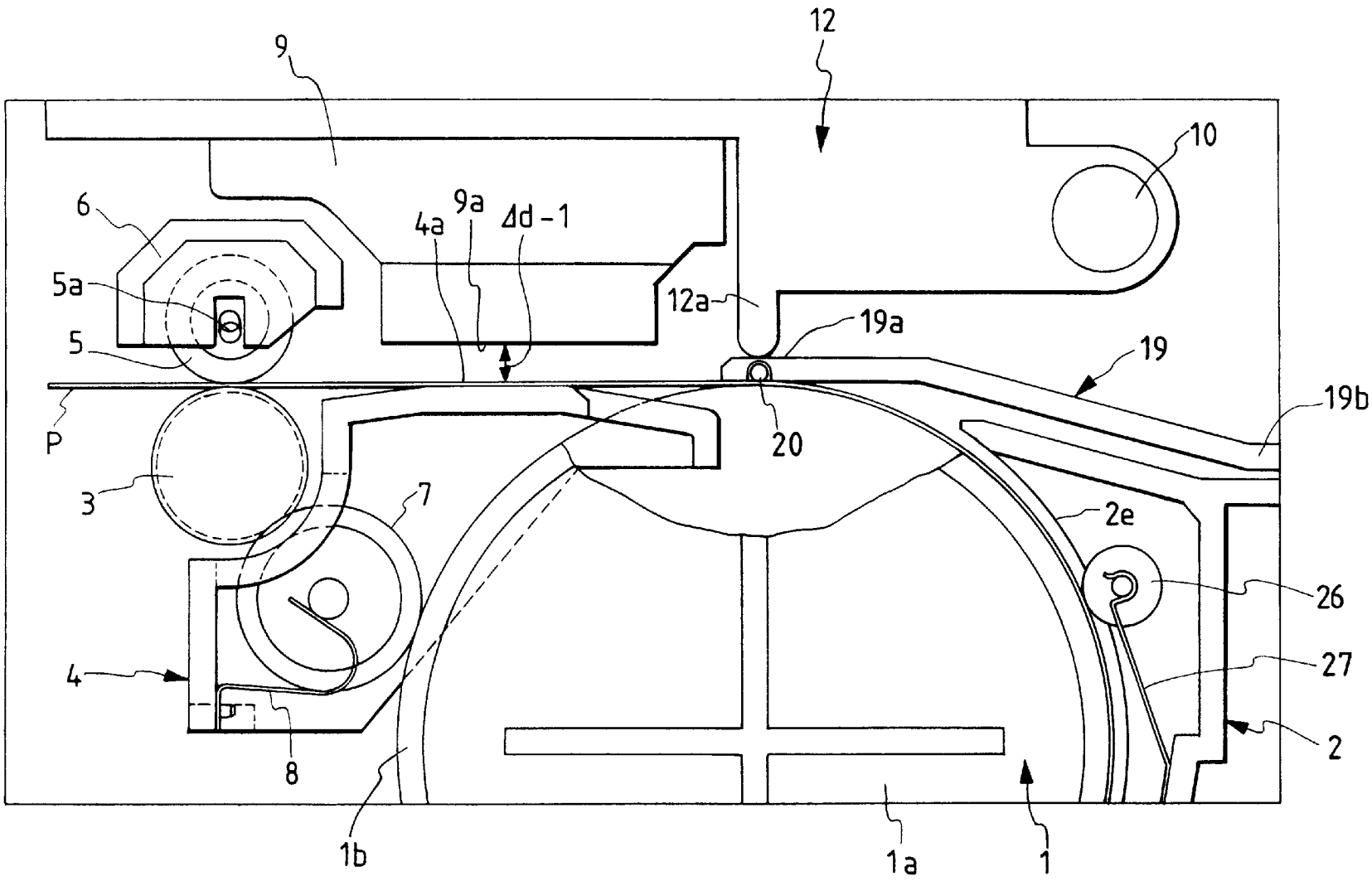
FIG. 16 is a sectional view of a main part of the conventional image recording apparatus, showing a condition that a thin recording medium is passing through a recording portion.
Figure 17:
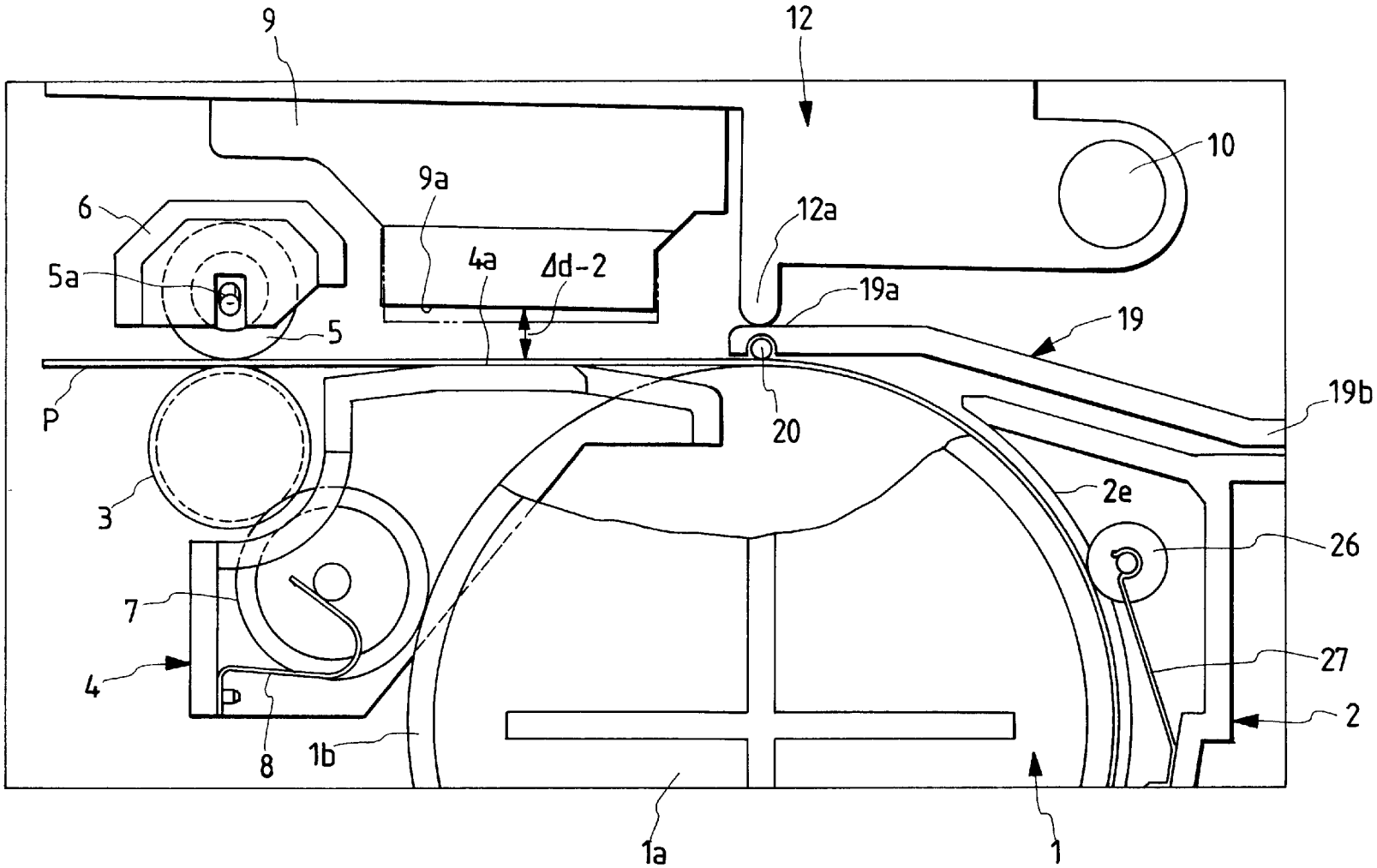
FIG. 17 is a sectional view of the main part of the conventional image recording apparatus, showing a condition that a thick recording medium is passing through the recording portion.

FIGS. 12 to 14 show a fourth embodiment of the present invention.

In the fourth embodiment, a manual insertion opening (not shown) and a manual insertion guide 41 are added to the second embodiment. The other arrangements are substantially the same as the second embodiment.

When the manual insertion sheet supply is effected, a recording medium P is inserted into the image recording apparatus through the manual insertion opening (not shown) until a tip end of the recording medium abuts against a nip formed between the main sheet feed roller 1 and the needle rollers 20. At this point, the recording medium is detected by a manual insertion sensor (not shown), and, after a predetermined time period is elapsed, the main sheet feed roller 1 is rotated in an anti-clockwise direction (FIG. 9) by a control means. Thereafter, the image is formed on the recording medium in the same manner as the second embodiment.

A plurality of convey peripheral surfaces (convey portions) 1*b* are formed equidistantly in an axial direction are on the main sheet feed roller 1. A small diameter portion is formed between the adjacent convey peripheral surfaces 1*b*.

A platen 4 has support arms 4*e* entered into the small diameter portions of the main sheet feed roller 1, and the rock roller 14 is rotatably supported by the support arms. The rock roller 14 is urged against the needle rollers 20 by a biasing force of the platen spring 28 for biasing the platen 4 upwardly.

As in the first embodiment, by appropriately selecting the positional relation between the guide shaft 10, slide portion 12*a,* needle rollers 20, nozzle surface 9*a,* rotary shafts 4*c,* rock roller 14 and recording surface 4*a,* the distance between the nozzle surface 9*a* and the recording surface 4*a* can always be kept substantially constant.

In the above embodiments, while an example in which the needle rollers 20 and the recording head 9 are connected to each other via the pressure plate 19 and the carrier 12 was explained, the present invention is not limited to such an example. Alternatively, the needle rollers 20 may be directly connected to the recording head 9.

Further, while an example in which the rock roller 14 is provided on the platen 4 was explained, a connection means such as a lever, a link or the like may be disposed between the rock roller 14 and the platen 4 to transmit the displacement of the rock roller 14 to the platen 4.

What is claimed is:

1. An image recording apparatus comprising:

a platen having a recording surface on which a recording medium being conveyed is rested;

a recording head disposed above said recording surface of said platen for recording an image on the recording medium;

a carrier for holding said recording head and reciprocally shifting in a direction perpendicular to a recording medium conveying direction; and a main convey roller rotated around a rotation axis for conveying the recording medium onto said recording surface of said platen;

wherein said carrier can be rotated around a guide shaft so that a surface of said recording head opposed to the recording medium is rotated toward and away from said recording surface of said platen, and a part of said carrier is directly or indirectly contacted with an outer peripheral surface of said main convey roller so that said carrier is rotated around said guide shaft in response to rotational displacement of said main convey roller; and said platen is supported for rotational movement around a support shaft so that, when said platen is rotated around said support shaft, the recording surface is shifted toward and away from the surface of said recording head opposed to the recording medium, and said platen can be rotated around said support shaft in response to the rotational movement of said carrier around said guide shaft.

2. An image recording apparatus according to claim 1, wherein a part of said platen rotatable around said support shaft is always contacted with the outer peripheral surface of said main convey roller directly or indirectly by a weight of said platen itself so that said platen is rotated around said support shaft in response to the rotational movement of said carrier around said guide shaft.

3. An image recording apparatus according to claim 1, wherein a part of said platen rotatable around said support shaft is always contacted with the outer peripheral surface of said main convey roller indirectly by a biasing force of a biasing member so that said platen is rotated around said support shaft in response to the rotational movement of said carrier around said guide shaft.

4. An image recording apparatus according to claim 1, wherein a part of said carrier is contacted with the outer peripheral surface of said main convey roller via a recording medium hold-down member for holding down the recording medium conveyed by said main convey roller.

5. An image recording apparatus according to claim 3, wherein a part of said platen is contacted with said carrier via a recording medium hold-down member for holding down the recording medium conveyed by said main convey roller.

6. An image recording apparatus according to claim 4, wherein a distance between said recording medium hold-down member and the outer peripheral surface of said main convey roller is changed in accordance with a thickness of the recording medium and rotational displacement of said main convey roller.

7. An image recording apparatus according to claim 5, wherein a distance between said recording medium hold-down member and the outer peripheral surface of said main convey roller is changed in accordance with a thickness of the recording medium and rotational displacement of said main convey roller.

8. An image recording apparatus according to one of claims 4 to 7, wherein said recording medium hold-down member is provided with a roller for holding down the recording medium.

9. An image recording apparatus according to claim 8, wherein a part of said carrier is urged against a portion of said recording medium hold-down member on which said roller is disposed.

10. An image recording apparatus according to claim 8, wherein a part of said platen is urged against said roller of said recording medium hold-down member directly or indirectly.

11. An image recording apparatus according to claim 1, wherein said platen is provided with a sub convey roller for conveying the recording medium passed through said recording surface of said platen, a spur for cooperating with said sub convey roller to pinch and convey the recording medium, and an idle roller for transmitting rotation of said main convey roller to said sub convey roller.

12. An image recording apparatus according to claim 1, wherein said recording head is an ink jet head for ejecting ink from a nozzle surface thereof opposed to said recording surface of said platen.

13. An image recording apparatus comprising:

a rotary member for conveying a sheet of recording medium;

recording means for recording an image on the recording medium conveyed by said rotary member; and a guide member opposed to said recording means for guiding the sheet at a record position of said recording means;

wherein first and second followers are contacted with a peripheral surface of said rotary member directly or indirectly and displaced in response to displacement of the peripheral surface of said rotary member caused by rotation of said rotary member;

wherein said first follower is connected to said recording means directly or indirectly to displace said recording means in a direction transverse to a sheet conveying direction in response to the displacement of said first follower; and wherein said second follower is connected to said guide member directly or indirectly to displace said guide member in a direction transverse to the sheet conveying direction in response to the displacement of said second follower.

14. An image recording apparatus according to claim 13, wherein said recording means is displaced toward and away from said guide member in response to the displacement of said first follower, and said guide member is displaced toward and away from said recording means in response to the displacement of said second follower.

15. An image recording apparatus according to claim 13, wherein said recording means and said guide means are displaced in the same direction in response to the displacement of said first and second followers, respectively.

16. An image recording apparatus according to claim 13, wherein said rotary member contacts with a sheet stack to supply a single sheet from the sheet stack.

17. An image recording apparatus according to claim 13, further comprising a manual insertion guide for guiding a sheet inserted into the apparatus to a position where the sheet is conveyed by said rotary member.

18. An image recording apparatus according to claim 13, wherein said first follower is contacted with the peripheral surface of said rotary member via the sheet being conveyed by said rotary member.

* * * * *

UNITED STATES PATENT AND TRADEMARK OFFICE

CERTIFICATE OF CORRECTION

PATENT NO. : 6,129,461

DATED : October 10, 2000

INVENTOR(S) : NAKAI

It is certified that error appears in the above-identified patent and that said Letters Patent is hereby corrected as shown below:

COLUMN 2:
Line 41, "the good recording." should read --good recording.--.

COLUMN 3:
Line 15, "light-weight" should read --light weight--.
Line 17, "having" should read --having a--.

COLUMN 6:
Line 45, "a tip end" should read --when a tip end--.

COLUMN 7:
Line 62, "the errors" should read --errors--.

COLUMN 8:
Line 33, "surface" (first occurrence) should read --medium--.
Line 35, "the good" should read --a well--.
Line 44, "to" should be deleted.

UNITED STATES PATENT AND TRADEMARK OFFICE

CERTIFICATE OF CORRECTION

PATENT NO. : 6,129,461

DATED : October 10, 2000

INVENTOR(S) : NAKAI

It is certified that error appears in the above-identified patent and that said Letters Patent is hereby corrected as shown below:

COLUMN 9:

Line 57, "are" should be deleted.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*